US006605010B1

(12) United States Patent
Rydza

(10) Patent No.: US 6,605,010 B1
(45) Date of Patent: Aug. 12, 2003

(54) BALL/PUCK AUTOMATIC SHOOTER APPARATUS

(76) Inventor: Donald Rydza, 6243 Bartz Rd., Lockport, NY (US) 14094

( * ) Notice: Subject to any disclaimer, the term of this patent is extended or adjusted under 35 U.S.C. 154(b) by 0 days.

(21) Appl. No.: 10/038,442

(22) Filed: Jan. 7, 2002

(51) Int. Cl.[7] ..... A63B 69/00
(52) U.S. Cl. ..... 473/446; 473/451
(58) Field of Search ..... 473/446, 422, 473/451–53, 17; 273/391; 124/1, 7, 16, 78

(56) References Cited

U.S. PATENT DOCUMENTS 3,989,245 A * 11/1976 Augustine et al. ..... 473/431
5,160,131 A * 11/1992 Leon ..... 473/451
6,164,271 A * 12/2000 Paulson et al. ..... 124/78
6,190,271 B1 * 2/2001 Rappaport et al. ..... 473/451

* cited by examiner

*Primary Examiner*—Paul T. Sewell
*Assistant Examiner*—M. Chambers

(57) ABSTRACT

A ball/puck automatic shooter apparatus for varying the directions from which the balls/pucks are being launched. The ball/puck automatic shooter apparatus includes a conventional base member, a conventional ball/puck release magazine including a first motor and rollers for holding and launching balls/pucks, a conventional power source, and a conventional vertically-disposed ball/puck feeder member being attached to the ball/puck release magazine, wherein the improvement comprises a dispensing chute being rotatably attached to a dispensing end of the ball/puck release magazine; and also includes an assembly for rotating and positioning the dispensing chute; and further includes an assembly for selective launching of the balls/pucks from the ball/puck release magazine.

3 Claims, 4 Drawing Sheets

BALL/PUCK AUTOMATIC SHOOTER APPARATUS

BACKGROUND OF THE INVENTION

1. Field of the Invention

The present invention relates to improved ball/puck launchers and more particularly pertains to a new ball/puck automatic shooter apparatus for varying the directions from which the balls/pucks are being launched.

2. Description of the Prior Art

The use of improved ball/puck launchers is known in the prior art. More specifically, improved ball/puck launchers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,707,304; 5,255,917; 5,161,799; 5,465,978; Des. 301,906. None of the prior art can easily change the directions from which the balls/pucks can be launched.

While these devices fulfill their respective, particular objectives and requirements, the aforementioned patents do not disclose a new ball/puck automatic shooter apparatus. The inventive device includes a conventional base member, a conventional ball/puck release magazine including a first motor and rollers for holding and launching balls/pucks, a conventional power source, and a conventional vertically-disposed ball/puck feeder member being attached to the ball/puck release magazine, wherein the improvement comprises a dispensing chute being rotatably attached to a dispensing end of the ball/puck release magazine; and also includes an assembly for rotating and positioning the dispensing chute; and further includes an assembly for selective launching of the balls/pucks from the ball/puck release magazine; improved features not described nor suggested by the prior art.

In these respects, the ball/puck automatic shooter apparatus according to the present invention substantially departs from the conventional concepts and designs of the prior art, and in so doing provides an apparatus primarily developed for the purpose of varying the directions from which the balls/pucks are being launched.

SUMMARY OF THE INVENTION

The general purpose of the present invention, which will be described subsequently in greater detail, is to provide a new ball/puck automatic shooter apparatus which has many of the advantages of the improved ball/puck launchers mentioned heretofore and many novel features that result in a new ball/puck automatic shooter apparatus which is not anticipated, rendered obvious, suggested, or even implied by any of the prior art improved ball/puck launchers, either alone or in any combination thereof.

There has thus been outlined, rather broadly, the more important features of the ball/puck automatic shooter apparatus in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new ball/puck automatic shooter apparatus which has many of the advantages of the improved ball/puck launchers mentioned heretofore and many novel features that result in a new ball/puck automatic shooter apparatus which is not anticipated, rendered obvious, suggested, or even implied by any of the prior art improved ball/puck launchers, either alone or in any combination thereof.

Still another object of the present invention is to provide a new ball/puck automatic shooter apparatus for varying the directions from which the balls/pucks are being launched.

Still yet another object of the present invention is to provide a new ball/puck automatic shooter apparatus that is easily and convenient to use.

Even still another object of the present invention is to provide a new ball/puck automatic shooter apparatus that allows the user to practice receiving balls/pucks from various angles.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
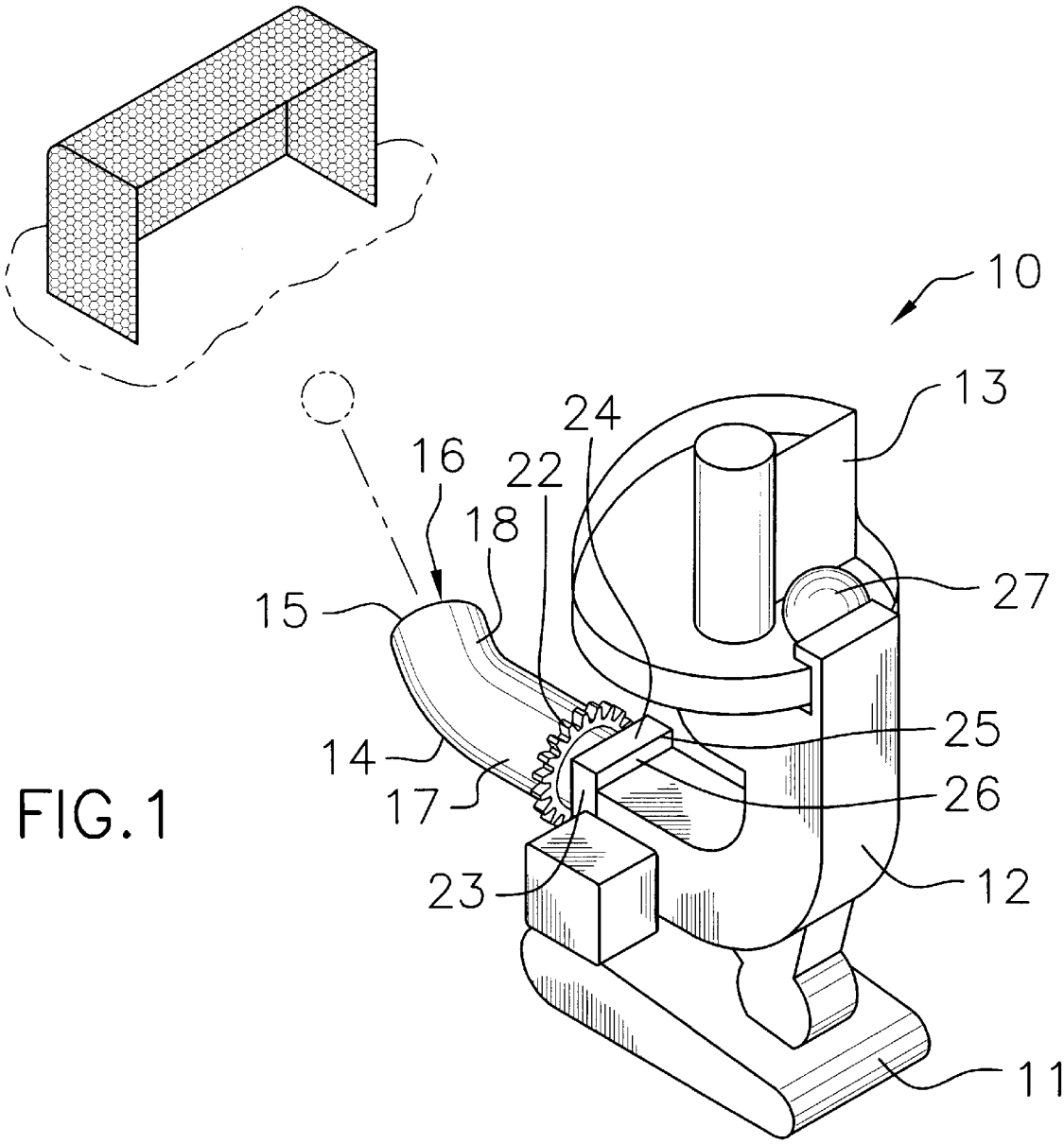
FIG. 1 is a perspective view of a new ball/puck automatic shooter apparatus according to the present invention and shown in use.
Figure 2:
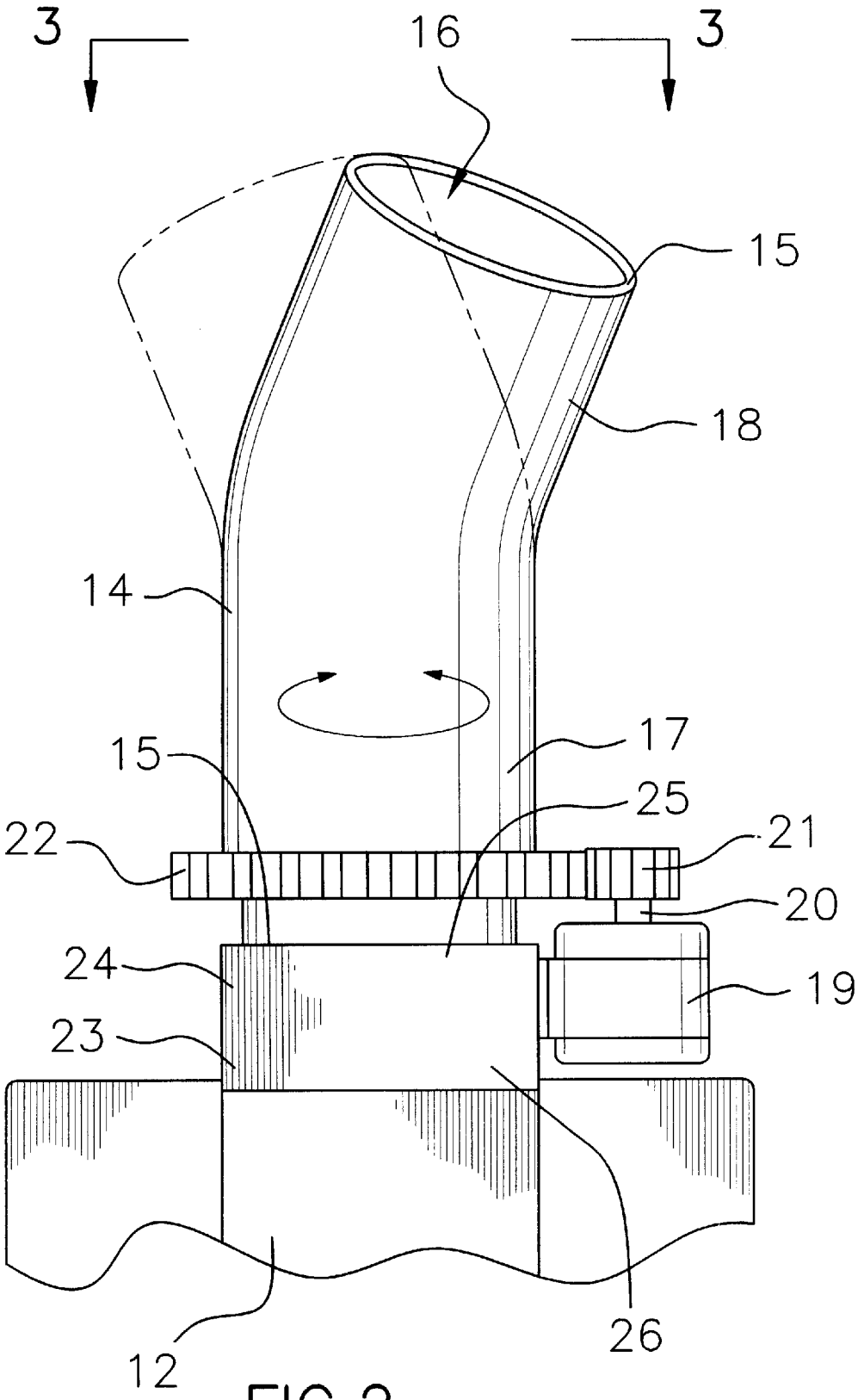
FIG. 2 is a detailed side elevational view of the dispensing chute member of the present invention.
Figure 3:
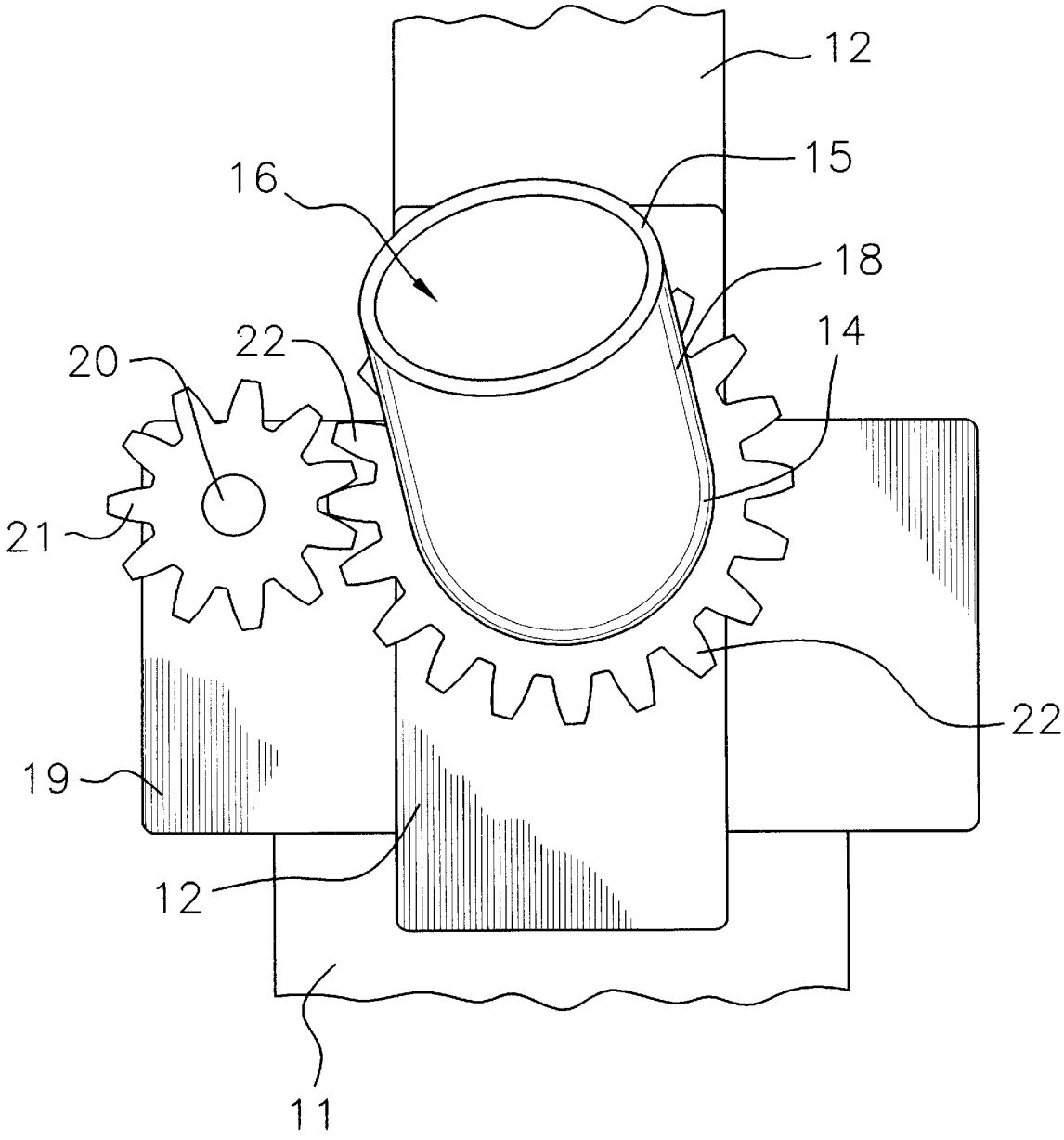
FIG. 3 is a detailed side elevational view of the dispensing chute member of the present invention.
Figure 4:
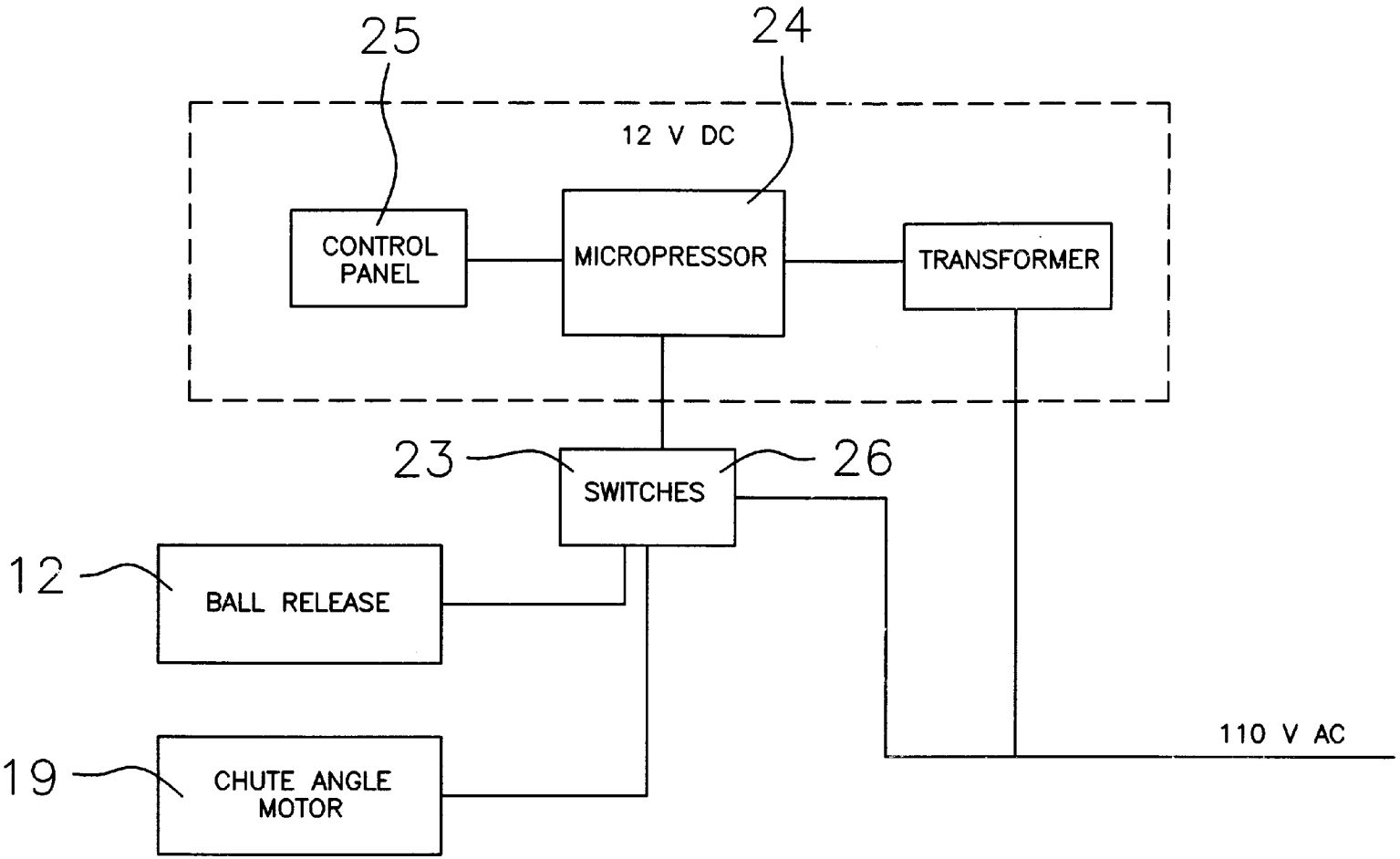
FIG. 4 is a schematic diagram of the present invention

With reference now lo the drawings, and in particular to FIGS. 1 through 4 thereof, a new ball/puck automatic shooter apparatus embodying the principles and concepts of the present invention and generally designated by the reference numeral 10 will be described.

As best illustrated in FIGS. 1 through 4, the ball/puck automatic shooter apparatus 10 generally includes a conventional base member 11, a conventional ball/puck release magazine 12 including a first motor and rollers for holding and launching balls/pucks, a conventional power source, and a conventional vertically-disposed ball/puck feeder member 13 being conventionally attached to the ball/puck release magazine 12, wherein the improvement comprises a dispensing chute 14 being rotatably and conventionally attached to a dispensing end of the, ball/puck release magazine 12. The dispensing chute 14 is a tubular member having open ends 15, a bore 16 being extended therethrough, and also having a first portion 17 which is conventionally attached to the ball/puck release magazine 12, and further having a second portion 18 which is angled relative to the first portion 17 to vary directions from which the balls/pucks 27 are being launched. The second portion 18 of the dispensing chute 14 has a longitudinal axis which is angled relative to a longitudinal axis of the first portion 17 of the dispensing chute 14 to facilitate changing of launching directions of the balls/pucks 27.

A means for rotating the dispensing chute 14 includes a second motor 19 being conventionally mounted to the base member 11 and being adapted to be connected to the power source, and also includes a shaft 20 being rotatably and conventionally mounted to the second motor 19, and further includes a first gear 21 being conventionally mounted to the shaft 20 for rotation therewith, and also includes a second gear 22 being conventionally mounted about the dispensing chute 14 and being engagable to the first gear 21, and further includes a first switch 23 being conventionally connected to the second motor 19 and being adapted to be connected to the power source, and also includes a microprocessor 24 being conventionally connected to the first switch 23 and being adapted to be connected to the power source, and further includes a conventional control unit 25 such as a control panel for operating the microprocessor 24 and the first switch 23. The second gear 22 is conventionally mounted about the first portion 17 of the dispensing chute 14.

A means for selective launching of the balls/pucks 27 from the ball/puck release magazine 12 includes a second switch 26 being conventionally connected to the conventional ball/puck release magazine 12 including the first motor for the energizing thereof, and also includes the microprocessor 24 being conventionally connected to the second switch 26 and being programmed to energize the second switch 26 at selected intervals for launching the balls/pucks 27 from the conventional ball/puck release magazine 12.

In use, the user sets up the improved ball/puck shooter apparatus 10 upon a surface, and energizes the microprocessor 24 using the control unit 25 to first rotate the dispensing chute 14 to the selected angle or direction from which the balls/pucks 27 will be launched, and second to energize the first motor which actuates the rollers which shoot or launch the balls/pucks 27 from the conventional ball/puck release magazine 12 through the dispensing chute 14.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the ball/puck automatic shooter apparatus. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An improved ball/puck shooter apparatus comprising a conventional base member, a conventional ball/puck release magazine including a first motor and rollers for holding and launching balls/pucks, a conventional power source, and a conventional vertically-disposed ball/puck feeder member being attached to the ball/puck release magazine, wherein the improvement comprises:

a dispensing chute being rotatable attached to a dispensing end of said ball/puck release magazine, said dispensing chute is a tubular member having open ends, a bore being extended therethrough, and also having a first portion which is attached to said ball/puck release magazine, and further having a second portion which is angled relative to said first portion to vary directions from which the balls/pucks are being launched;

a means for rotating said dispensing chute including a second motor being mounted to said base member and being adapted to be connected to said power source, and also including a shaft being rotatably mounted to said second motor, and further including a first gear being mounted to said shaft for rotation therewith, and also including a second gear being mounted about said dispensing chute and being engageable to said first gear, and further including a first switch being connected to said second motor and being adapted to be connected to said power source, and also including a microprocessor being connected to said first switch and being adapted to be connected to said power source, and further including a control unit for operating said microprocessor and said first switch; and a means for selective launching of the balls/pucks from said ball/puck release magazine.

2. An improved ball/puck shooter apparatus as described in claim 1, wherein said second gear is mounted about said first portion of said dispensing chute.

3. An improved ball/puck shooter apparatus as described in claim 1, wherein said means for selective launching of the balls/pucks includes a second switch being connected to said conventional ball/puck release magazine including said first motor for the energizing thereof, and also includes said microprocessor being connected to said second switch and being programmed to energize said second switch at selected intervals for launching the balls/pucks from said conventional ball/puck release magazine.

* * * * *